US012312890B2

(12) United States Patent
Alshehri et al.

(10) Patent No.: US 12,312,890 B2
(45) Date of Patent: May 27, 2025

(54) WHIPSTOCK INTEGRATED TO COMPLETION STRING FOR COILED TUBING OPERATIONS

(71) Applicant: SAUDI ARABIAN OIL COMPANY, Dhahran (SA)

(72) Inventors: Mohammed A. Alshehri, Dammam (SA); Atallah N. Alharbi, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 124 days.

(21) Appl. No.: 18/342,370

(22) Filed: Jun. 27, 2023

(65) Prior Publication Data

US 2025/0003302 A1 Jan. 2, 2025

(51) Int. Cl.

| | |
|---|---|
| ***E21B 29/06*** | (2006.01) |
| ***E21B 7/06*** | (2006.01) |
| ***E21B 7/08*** | (2006.01) |
| ***E21B 17/02*** | (2006.01) |
| ***E21B 17/04*** | (2006.01) |
| ***E21B 17/046*** | (2006.01) |

(Continued)

(52) U.S. Cl.

CPC ..... *E21B 29/06* (2013.01); *E21B 7/061* (2013.01); *E21B 17/021* (2013.01); *E21B 17/041* (2020.05); *E21B 17/046* (2013.01); *E21B 23/01* (2013.01); *E21B 4/02* (2013.01); *E21B 7/068* (2013.01)

(58) Field of Classification Search

CPC ..... E21B 29/06; E21B 7/061; E21B 17/021; E21B 17/041; E21B 17/046

See application file for complete search history.

(56) References Cited

U.S. PATENT DOCUMENTS 2,331,293 A * 10/1943 Ballard ..... E21B 7/061 175/82
2,667,332 A * 1/1954 McCune ..... E21B 17/046 175/323

(Continued)

FOREIGN PATENT DOCUMENTS

CA 2343190 C 6/2006

*Primary Examiner* — Blake Michener
(74) *Attorney, Agent, or Firm* — Osha Bergman Watanabe & Burton LLP/Saudi Aramco

(57) ABSTRACT

A system includes coiled tubing connected to a bottom hole assembly, a latching tool removably connected to the completion string using a completion shear pin, configured to connect to the bottom hole assembly, having a stationary portion and a rotational portion overlayed on top of the stationary portion, wherein a first position of the latching tool comprises the rotational portion movably disposed around an outer circumferential surface of the stationary portion and a second position of the latching tool comprises the rotational portion immovably disposed around the outer circumferential surface of the stationary portion, a milling section connected to the latching tool and configured to receive weight and rotational movement from the coiled tubing to sidetrack the well when the latching tool is in the second position, and a whipstock removably connected to the milling section via a mill shear pin and having anchor slips configured to jut out into and engage with an inner circumferential surface of the well when an anchor shear pin is broken.

20 Claims, 6 Drawing Sheets

(51) Int. Cl.
*E21B 23/01* (2006.01)
*E21B 4/02* (2006.01)

(56) References Cited

U.S. PATENT DOCUMENTS

| | | | | | |
|---|---|---|---|---|---|
| 5,551,509 | A * | 9/1996 | Braddick | E21B 29/06 | 175/81 |
| 5,787,978 | A * | 8/1998 | Carter | E21B 23/042 | 166/117.6 |
| 5,826,651 | A * | 10/1998 | Lee | E21B 23/01 | 166/117.6 |
| 5,887,655 | A * | 3/1999 | Haugen | E21B 7/061 | 175/425 |
| RE43,054 | E | 1/2012 | Bailey | | |
| 8,844,620 | B2 * | 9/2014 | Gregurek | E21B 7/061 | 175/81 |
| 9,447,650 | B2 * | 9/2016 | Haun | E21B 29/06 | |
| 12,140,024 | B2 * | 11/2024 | Al Rubaya | E21B 47/09 | |
| 2002/0170713 | A1 * | 11/2002 | Haugen | E21B 29/02 | 166/117.6 |
| 2019/0003264 | A1 * | 1/2019 | Swadi | E21B 29/002 | |
| 2022/0389771 | A1 * | 12/2022 | Niu | E21B 17/042 | |

* cited by examiner

WHIPSTOCK INTEGRATED TO COMPLETION STRING FOR COILED TUBING OPERATIONS

BACKGROUND

Hydrocarbons are located in porous rock formations far beneath the Earth's surface. Wells are drilled into these formations to access and produce the hydrocarbons. Wells are created by drilling a wellbore into the Earth's surface. A casing string is run into the wellbore to provide structural support for the well. Often, the wellbore is drilled and cased in multiple sections using different sized drill bits and different sized casing strings. Once the well is drilled and cased, the well may be completed using various completion strategies which may include installing a completion string. There are many scenarios that would require a sidetrack to be drilled from the primary well using a whipstock. These scenarios could occur at any stage of the well, from drilling the first section of the primary wellbore to after the well has been producing for a period of time using the completion string.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and systems for sidetracking a well having a completion string. The system includes coiled tubing connected to a bottom hole assembly, a latching tool removably connected to the completion string using a completion shear pin, configured to connect to the bottom hole assembly, having a stationary portion and a rotational portion overlayed on top of the stationary portion, wherein a first position of the latching tool comprises the rotational portion movably disposed around an outer circumferential surface of the stationary portion and a second position of the latching tool comprises the rotational portion immovably disposed around the outer circumferential surface of the stationary portion, a milling section connected to the latching tool and configured to receive weight and rotational movement from the coiled tubing to sidetrack the well when the latching tool is in the second position, and a whipstock removably connected to the milling section via a mill shear pin and having anchor slips configured to jut out into and engage with an inner circumferential surface of the well when an anchor shear pin is broken.

The method includes making up a completion string comprising a latching tool removably connected to the completion string, a milling section connected to the latching tool, and a whipstock removably connected to the milling section, installing the completion string in the well with the latching tool in a first position, wherein the first position of the latching tool comprises a rotational portion movably disposed around an outer circumferential surface of a stationary portion, deploying a coiled tubing having a bottom hole assembly into the completion string to connect the bottom hole assembly to the latching tool, and placing the latching tool into a second position, wherein the second position of the latching tool comprises the rotational portion immovably disposed around the outer circumferential surface of the stationary portion. The method further includes shearing an anchor shear pin to jut anchor slips from the whipstock to engage with an inner circumferential surface of a wall of the well, a completion shear pin to disconnect the latching tool from the completion string, and a mill shear pin to disconnect the whipstock from the milling section, kicking off the milling section from the whipstock into the wall of the well, and milling through the wall of the well by rotating the milling section using rotational force and weight from the coiled tubing and the bottom hole assembly to sidetrack the well.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
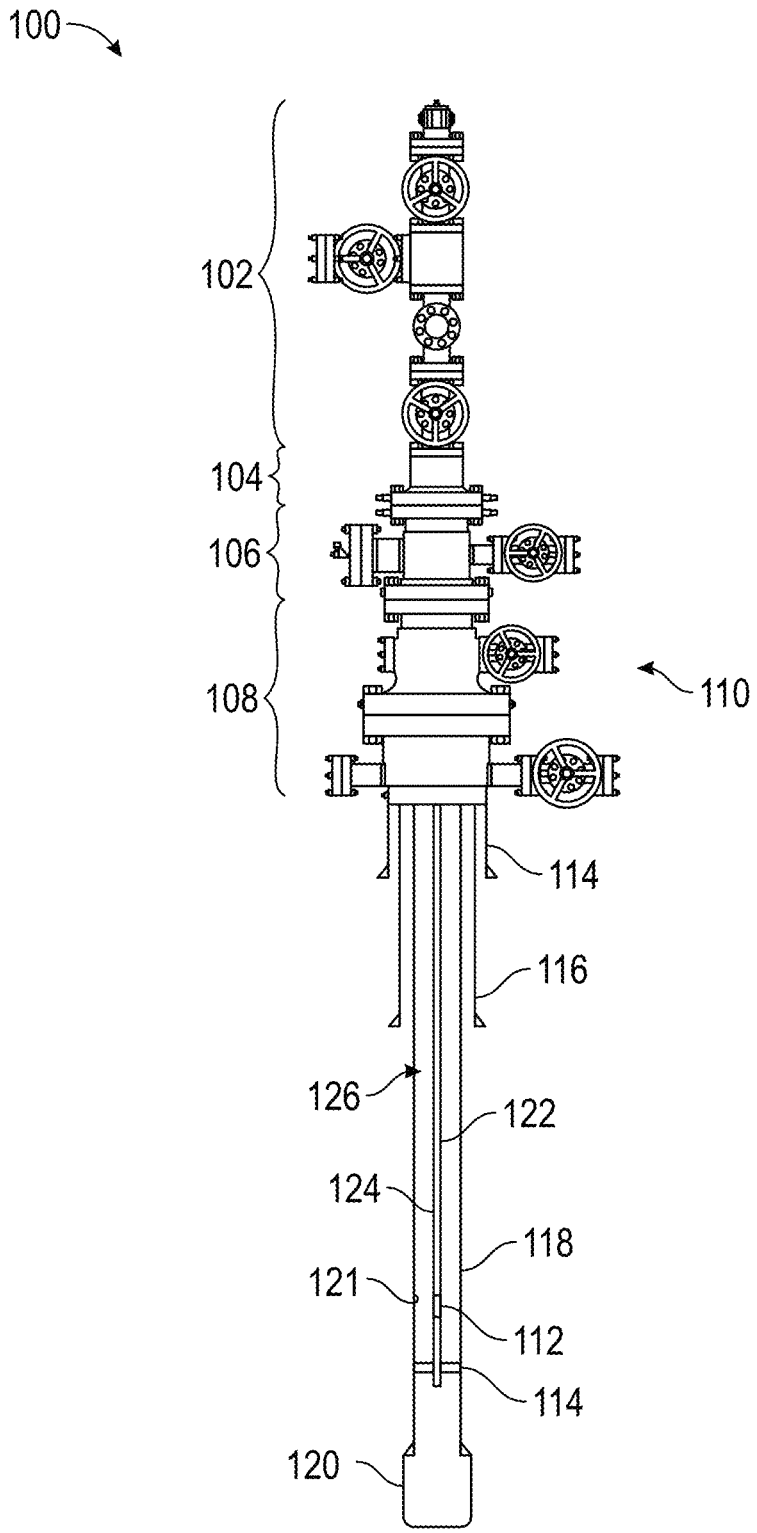
FIG. 1 shows a well in accordance with one or more embodiments.

FIG. 1 shows a well (100) in accordance with one or more embodiments. The well (100) shown in FIG. 1 is shown for example only and is not meant to be limiting. The well (100) includes a tree (102), a tubing bonnet (104), a tubing head (106), and a casing head (108) located on a surface location (110) that may be located anywhere on the Earth's surface. The tree (102) has a plurality of valves that are configured to control the production of production fluids that come from a production zone located beneath the surface location (110). The valves also allow for access to the subsurface portion of the well (100).

In accordance with one or more embodiments, the well (100) has three strings of casing: conductor casing (114), surface casing (116), and production casing (118). The casing strings are made of a plurality of long high-diameter tubulars threaded together. The tubulars may be made out of any durable material known in the art, such as steel. The casing strings are cemented in place within the well (100). The casing strings may be fully or partially cemented in place without departing from the scope of the disclosure herein.

Each string of casing, starting with the conductor casing (114) and ending with the production casing (118), decreases in both outer diameter and inner diameter such that the surface casing (116) is nested within the conductor casing (114) and the production casing (118) is nested within the surface casing (116). Upon completion of the well (100), the inner circumferential surface (121) of the production casing (118) and the space located within the production casing (118), make up the interior of the well (100).

The majority of the length of the conductor casing (114), surface casing (116), and production casing (118) are located underground. However, the surface-extending portion of each casing string is housed in the casing head (108), also known as a wellhead, located at the surface location (110). The surface-extending portion of each casing string may include a casing hanger (not pictured) that is specially machined to be set and hung within the casing head (108). There may be multiple casing heads (108) depending on the number of casing strings without departing from the scope of the disclosure herein.

A completion string (122) is shown deployed within the production casing (118). The completion string (122) is made of a plurality of tubulars connected together and may be interspersed with various pieces of completion equipment such as artificial lift equipment, fluid separation equipment, etc. The space formed between the outer circumferential surface (124) of the completion string (122) and the inner circumferential surface (121) of the production casing (118) may be called the tubing-casing annulus (126).

In further embodiments, the completion string (122) includes, at least, a polished bore receptacle (112) and a packer (114). The packer (114) extends radially outward from an external circumferential surface of the completion string (122) to seal against an internal circumferential surface of the production casing (118). The seal between the completion string (122) and the production casing (118) prevents production fluids from migrating up hole from the packer (114). The fluid isolation may ensure that the production fluids are directed into the completion string (122). In accordance with one or more embodiments, the polished bore receptacle (112) may act as an expansion joint, a seal bore for equipment, and may ensure isolation of pressure across the completion string (122).

In accordance with one or more embodiments, the majority of the length of the completion string (122) is located in the interior of the well (100) underground. However, the surface-extending portion of the completion string (122) is housed in the tubing head (106), which is installed on top of the casing head (108). The surface-extending portion of the completion string (122) may include a tubing hanger (not pictured) that is specially machined to be set and hung within the tubing head (106). The tree (102) is connected to the top of the tubing head (106) using the tubing bonnet (104). The tubing bonnet (104) is an adapter comprising one or more seals (not pictured).

In accordance with one or more embodiments, the production casing (118) may comprise a portion made of slotted casing or screen such that production fluids may flow into the production casing (118) from the formation. In other embodiments, the production casing (118) may include perforations made through the production casing (118), cement, and wellbore in order to provide a pathway for the production fluids to flow from the production zone into the interior of the well (100). In further embodiments, the production casing (118) is made entirely of solid-wall tubulars and the production fluids may flow into the well from the open hole (120) extending through the production zone.

The production fluids may travel from the interior of the well (100) to the surface location (110) through the completion string (122). A pipeline (not pictured) may be connected to the tree (102) to transport the production fluids away from the well (100). The well (100) depicted in FIG. 1 is one example of a well (100) but is not meant to be limiting. The scope of this disclosure encompasses any well (100) design that has at least one string of casing and one completion string installed in the well (100). Further, the well (100) may have other variations of surface equipment without departing from the scope of this disclosure.

FIG. 1 further shows an open hole (120). In accordance with one or more embodiments, the open hole (120) is an uncased portion of the wellbore that is drilled after the surface casing (116) is cemented in place. The open hole (120) is the portion of the wellbore that is uncovered by the production casing (118). In accordance with one or more embodiments, the open hole (120) may extend through the production zone allowing the production fluids to flow into the interior of the well (100). FIG. 1 does not show the completion string (122) extending into the open hole (120); however, this is not meant to be limiting and the completion string (122) may extend into the open hole (120) without departing from the scope of the disclosure herein.

In accordance with one or more embodiments, the wellbores housing the casing strings must be drilled using a drilling rig because only a drilling rig has the capabilities to handle casing and tubing installation. It may be beneficial to reduce the time utilizing a drilling rig by using a coiled tubing unit to drill the remainder of the open hole (120) to extend through the production zone, or sidetrack from the production casing (118) into the production zone.

In order to sidetrack a well (100) using only a coiled tubing unit, the drilling rig must perform all required operations first, which include installing the completion string (122). However, there exists a limited number of whipstock technologies that can perform a sidetrack operation with a completion string (122) concurrently installed in the well (100). As such, embodiments presented herein outline apparatuses, systems, and methods that enable a sidetrack operation to be performed on a well (100) using a whipstock system made-up to the completion string (122).

As further outlined below, a whipstock system is made-up with the completion string (122) as the completion string (122) is being installed in the well (100), using the drilling rig. Once the completion string (122), having the whipstock system, is installed, the drilling rig may rig-down from the well (100) and a coiled tubing unit may take over. The coiled tubing unit engages with a latching tool (206) in the whipstock system perform the sidetrack operation on the well (100).

Figure 2:
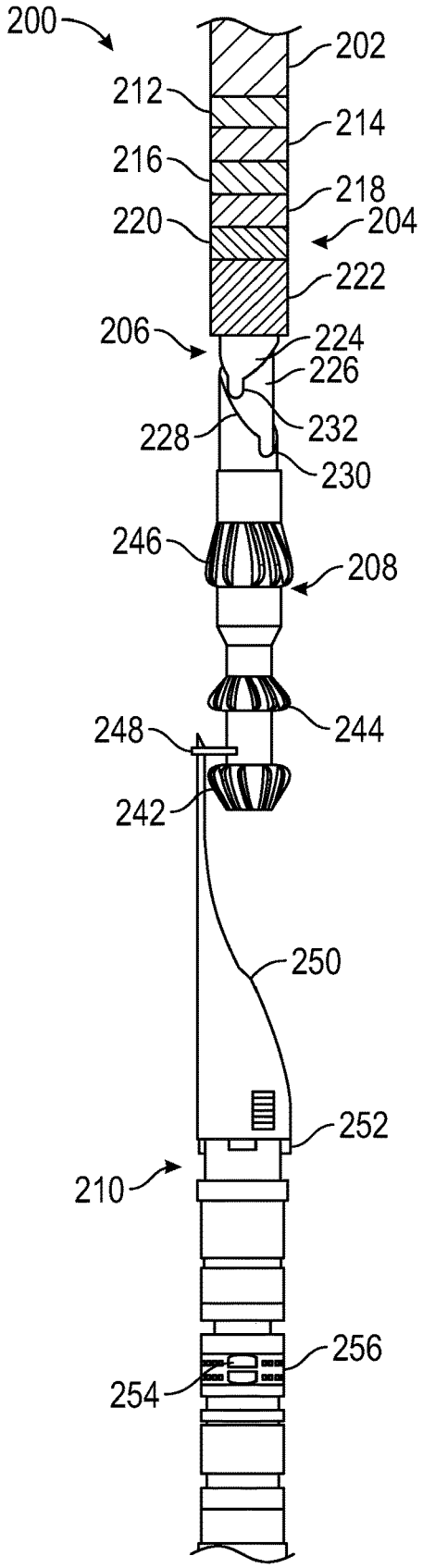
FIG. 2 shows a sidetrack system in accordance with one or more embodiments.

FIG. 2 shows a sidetrack system (200) in accordance with one or more embodiments. The sidetrack system (200) includes coiled tubing (202), a coiled tubing bottom hole assembly (BHA) (204), a latching tool (206), a milling section (208), and a whipstock (210). The coiled tubing (202) may be connected to a coiled tubing unit (not pictured). The coiled tubing unit may be used to lower and raise the coiled tubing (202) into and out of the well (100).

The coiled tubing unit includes pumps that may be used to pump a fluid into the inside of the coiled tubing (202). The coiled tubing unit may also include a fluid management system that is able to re-circulate the fluid being pumped into the well (100). In accordance with one or more embodiments, the coiled tubing (202) is made up of small outer diameter (for example, 0.75-4.5 inches) tubulars that are welded together. The coiled tubing (202) is made of a steel alloy that makes the material flexible enough to be wrapped around a spool, thus, the coiled tubing (202) is deformed by the curve to which it is bent.

In further embodiments, the coiled tubing (202) may have electronic transmission capabilities, similar to wireline. Thus, the coiled tubing (202) may be connected to a computer system (not pictured) located in the coiled tubing unit or elsewhere outside of the well (100). The computer system may be able to send and receive electronic signals containing data or instructions along the coiled tubing (202).

In accordance with one or more embodiments, the coiled tubing (202) is used to lower and raise the remainder of the sidetrack system (200) into and out of the well (100). The coiled tubing (202) is also used to provide a fluid, weight, and electronic control to the coiled tubing BHA (204).

The coiled tubing BHA (204) may be connected to the downhole end of the coiled tubing (202). The coiled tubing BHA (204) may have any required equipment needed to perform a sidetrack operation. For example, the coiled tubing BHA (204) may have a coiled tubing connector (212) that is used to connect the BHA (204) to the downhole end of the coiled tubing (202). The coiled tubing connector (212) may be connected externally or internally to the coiled tubing (202) and the coiled tubing connector (212) may provide any type of connection known in the art such as a threaded, bolted, or latched connection without departing from the scope of the disclosure herein.

A check valve (214) may be located within the BHA (204) to prevent backflow of liquids up the coiled tubing (202). That is, the check valve (214) may allow fluids to flow in a first direction from the coiled tubing (202) towards the latching tool (206) but does not allow fluids to flow in a second direction from the latching tool (206) towards the coiled tubing (202). One or more sets of jars (216) may be located in the BHA (204) to provide tensile or compressive force to the stuck coiled tubing (202).

In further embodiments, the BHA (204) may include a hydraulic disconnect (218). The hydraulic disconnect (218) may be activated by applying a pre-determined hydraulic force on the BHA (204). When the hydraulic disconnect (218) is activated, the portion of the BHA (204) located downhole from the hydraulic disconnect (218) may be separated from the up-hole portion. This allows a stuck BHA (204) to be left downhole while retrieving the remainder of the coiled tubing (202).

A vibrational tool (220), such as an agitator or an extended reach tool may be located within the BHA (204) to increase the friction coefficient between the coiled tubing (202) and whatever the coiled tubing (202) is milling into. This allows the coiled tubing (202) to extend deeper into a well (100). The vibrational tool (220) may operate by momentarily stopping the flow of fluid, thus creating a hammer effect. This pulse creates an axial force that allows coiled tubing (202) to overcome friction.

The BHA (204) may include a mud motor (222). The mud motor (222) may be used to provide rotational motion/force to the latching tool (206) of the sidetrack system (200). The mud motor (222) may use a series of stators and rotors (not pictured) that convert the power of the fluid flowing through the mud motor (222) into rotational energy.

Figure 3C:
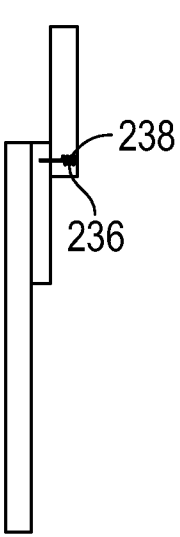
FIGS. 3*a*-3*c* show the latching tool in accordance with one or more embodiments.
Figure 3B:
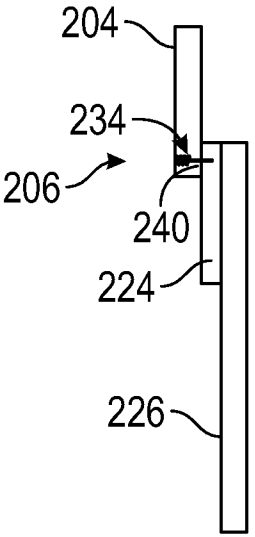
Figure 3B:
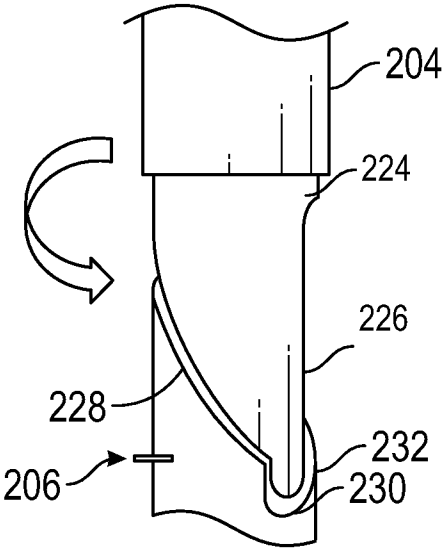
Figure 3A:
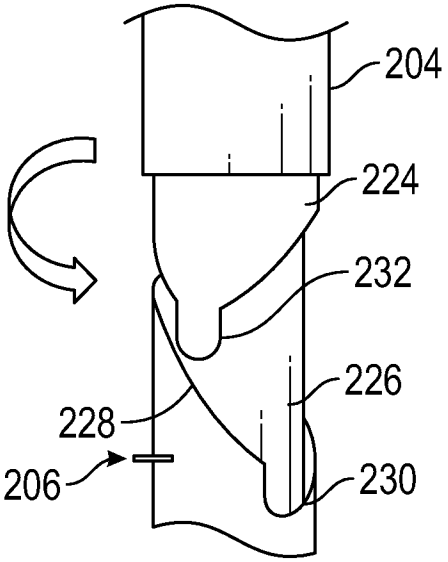

The latching tool (206) is further outlined in FIGS. 3*a*-3*c* in accordance with one or more embodiments. FIGS. 3*a* and 3*b* show an external side view of the latching tool (206). In particular, FIG. 3*a* shows the latching tool (206) in a first position and FIG. 3*b* shows the latching tool (206) in a second position. FIG. 3*c* shows a cross sectional view of the latching tool (206).

In accordance with one or more embodiments, the first position of the latching tool (206) prevents engagement and transference of rotational force and weight between the coiled tubing BHA (204) and the milling section (208). The second position of the latching tool (206) enables engagement and transference of rotational force and weight between the coiled tubing BHA (204) and the milling section (208).

In accordance with one or more embodiments, the latching tool (206) contains two portions, a rotational portion (224) and a stationary portion (226). The terms rotational and stationary are not meant to be limiting as to the complete rotational ability of the rotational portion (224) and the stationary portion (226). The rotational portion (224) has the ability to rotate while the stationary portion (226) stays stationary. However, when the rotational portion (224) fully engages with the stationary portion (226), as will be explained below, both the rotational portion (224) and the stationary portion (226) will have the ability to rotate.

Each component of the latching tool (206) may be made out of any material known in the art, such as a steel alloy. Both the rotational portion (224) and the stationary portion (226) of the latching tool (206) are formed in tubular-like shapes. The rotational portion (224) is overlayed on top of the stationary portion (226) of the latching tool (206). In the first position, the rotational portion (224) is movably disposed around the outer circumferential surface of the stationary portion (226). In the second position, the rotational portion (224) is immovably disposed around the outer circumferential surface of the stationary portion (226).

In accordance with one or more embodiments, the stationary portion (226) has a guide groove (228) machined into or connected to an outer circumferential surface of the stationary portion (226). The guide groove (228) is connected to or directed towards a slot (230). In other embodiments, the guide groove (228) is machined in a shape to have a slot (230), as shown in FIG. 3*a*. The rotational portion (224) has a key (232). The key (232) may be a specially machined portion of the stationary portion (226) tubular body as shown in FIGS. 3*a* and 3*b*.

The key (232) and the slot (230) are designed to mate with one another. That is, once the key (232) enters the slot (230), the physical shape of the key (232) and the slot (230) prevents the key (232) from being rotated out of the slot (230). In accordance with one or more embodiments the first position of the latching tool (206) has the key located out of the slot (230) and the second position of the latching tool (206) has the key (232) engaged within the slot (230).

In further embodiments, the latching tool (206) is able to move from the first position to the second position by rotation of the rotational portion (224) about the stationary portion (226). As the rotational portion (224) is rotated, the key (232) may be guided towards the slot (230) by the stationary guide groove (228) of the stationary portion (226).

The rotational portion (224) may be rotated using the mud motor (222) located in the coiled tubing BHA (204). Once the latching tool (206) is in the second position, the mud motor (222) is able to transfer rotation through the latching tool (206) to the milling section (208) of the sidetrack system (200). Weight from the coiled tubing (202) may also be transferred to the remainder of the sidetrack system (200) once the latching tool (206) is in the second position.

In accordance with one or more embodiments, the coiled tubing BHA (204) is connected to the latching tool (206) using a latch mechanism (234). The latch mechanism (234) is used to connect the coiled tubing BHA (204) to the latching tool (206). As further explained in FIGS. 4*a*-4*d*, the whipstock system is connected to the downhole end of the completion string (122) as the completion string (122) is made-up and installed in the well (100). Thus, the latch mechanism (234) is used to connect the BHA (204) to the latching tool (206) after the coiled tubing (202) and the BHA (204) have been run into the completion string (122).

In accordance with one or more embodiments, the latch mechanism (234) may have a spring-loaded lever. Specifically, the BHA (204) may have a lever (236) connected to a spring (238). The latching tool (206) may have a notch (240) configured to receive the lever (236). The notch (240) may be machined into the external circumferential surface of the rotational portion of the latching tool (206). The lever (236) and the spring (238) may be located within the wall of the BHA (204). The lever (236) may jut out from the BHA (204) into the notch (240) using the spring (238) when a portion of the latching tool (206) is located inside of the BHA (204). In further embodiments, the lever (236) may jut out of the BHA (204) when a signal is sent via the coiled tubing (202).

Turning back to FIG. 2, the latching tool (206) is connected to the milling section (208) using any type of connection known in the art, such as a threaded, welded, bolted, or latched connection. The milling section (208) includes one or more milling bits or dill bits that may be used to drill or mill a hole into the formation, a casing string (114, 116, 118), or a completion string (122). The milling section (208) is shown having three mill bits however any milling design, i.e., number and type of milling bits, may be used without departing from the scope of the disclosure herein.

As shown in FIG. 2, the milling section (208) has a lead mill (242), a follow mill (244), and a melon mill (246). The lead mill (242) the follow mill (244), and the melon mill (246) may have any bit or mill design known in the art as long as they are designed to grid or break down metal in a well (100). The lead mill (242) may be the mill located further downhole on the milling section (208), and the melon mill (246) may be the mill located furthest up hole on the milling section (208).

The lead mill (242) may be the mill that initially grinds down the metal and starts the hole in the material through which it is drilling. The follow mill (244) may have a slightly larger diameter than the lead mill (242) so that the hole being drilled into the material becomes larger. The melon mill (246) may have a slightly larger diameter than the follow mill (244) to further increase the size of the hole being drilled.

In accordance with one or more embodiments, the milling section (208) is removably connected to the whipstock (210). The milling section (208) may be connected to the whipstock using one or more mill shear pins (248). The mill shear pins (248) are designed to shear at a predetermined pressure so the whipstock (210) may be released from the remainder of the sidetrack system (200).

The whipstock (210) may be any type of tool that provides a kickoff point for the milling section (208). The whipstock (210) may be a retrievable whipstock (210) or a permanent whipstock (210) without departing from the scope of the disclosure herein. The whipstock (210) shown in FIG. 2 has a ramp (250), a hinge pin (252), and anchor slips (254).

In accordance with one or more embodiments, the ramp (250) enables a path for the milling section (208) to be directed towards the wall of the tubular through which the sidetrack system (200) is located. The hinge pin (252) allows two way movement of the whipstock (210) which provides a flexible point when running through doglegs of the well (100). The hinge pin (252) also ensures the whipstock (210) tip seats against the tubular when set in deviated wells.

In accordance with one or more embodiments, the anchor slips (254) are configured to jut out from the whipstock (210) to bite into/engage with the tubular through which the whipstock (210) is being run. Once the anchor slips (254) are engaged with the tubular, the whipstock (210) is able to hold itself up within the tubular and no longer needs to be connected to the remainder of the sidetrack system (200).

In further embodiments, the anchor slips (254) may be held within the whipstock (210) using one or more anchor shear pins (256), and the anchor slips (254) may jut out of the whipstock (210) when the anchor shear pins (256) are broken. The anchor shear pins (256) may be broken when a predetermined pressure is applied to the whipstock (210). In accordance with one or more embodiments, the pressure required to shear the anchor shear pins (256) is less than the pressure required to shear the mill shear pins (248).

That is, when the latching tool (206) is in the second position and weight is able to be transferred from the BHA (204) to the milling section (208) and the whipstock (210), a first slack off weight may be applied to shear the anchor shear pins (256) and set the whipstock (210) in the tubular. A second slack off weigh, that is larger than the first slack off weight, may then be applied to shear the mill shear pins (248) and detach the whipstock (210) from the milling section (208). At this point, the milling operation may be performed.

FIGS. 4*a*-4*d* show an operational sequence of using the sidetrack system (200) in a well (100) in accordance with one or more embodiments. Components shown in FIGS. 4*a*-4*d* that are the same as or similar to components shown in FIGS. 1-3*c* have not be re-described for purposes of readability and have the same description and function as outlined above.

Figure 4B:
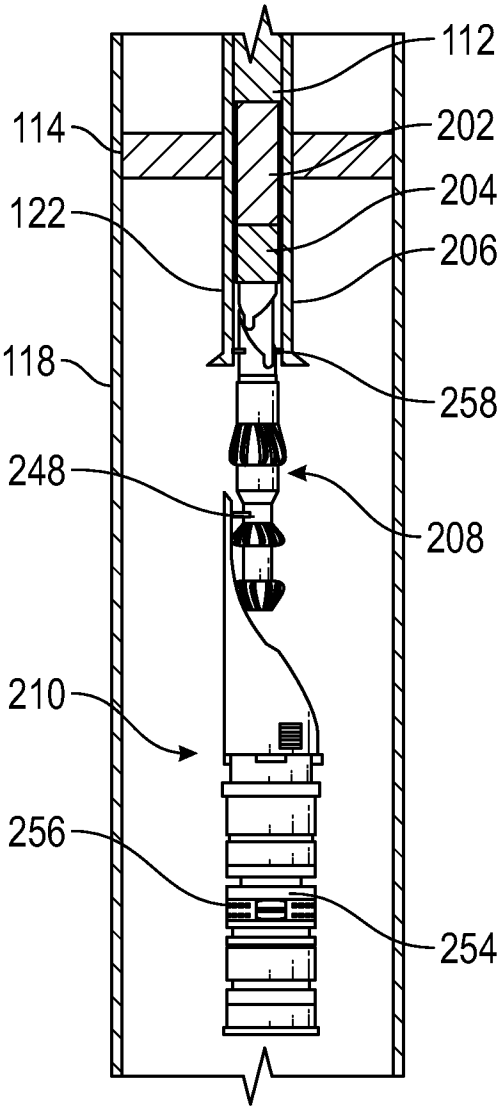
FIGS. 4*a*-4*d* show an operational sequence of using the sidetrack system in a tubular in accordance with one or more embodiments.
Figure 4A:
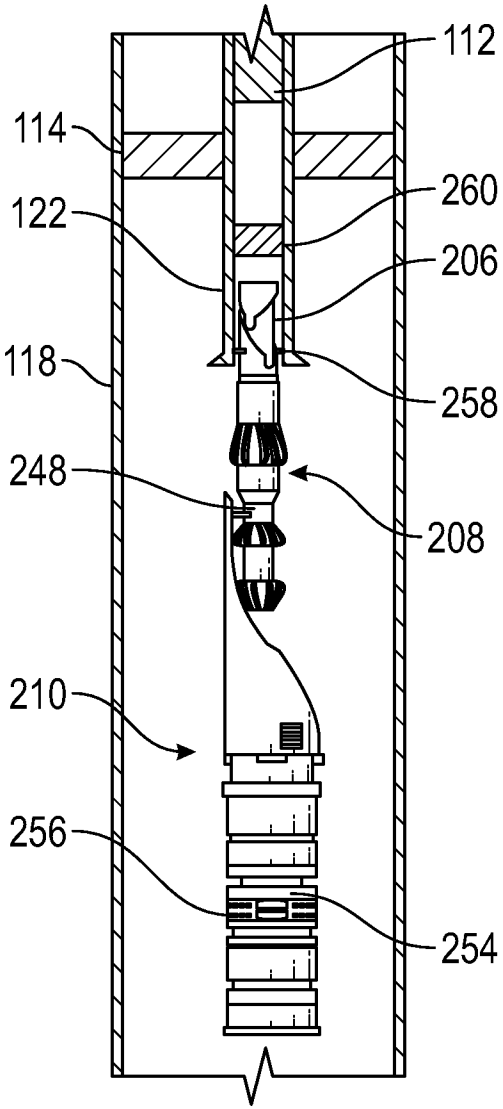

FIG. 4*a* shows the completion string (122) connected to the latching tool (206) using one or more completion shear pins (258) and installed inside of the production casing (118). The latching tool (206) is shown in the first position. The latching tool (206) is connected to the milling section (208) and the milling section (208) is connected to the whipstock (210) using the mill shear pins (248). In accordance with one or more embodiments, the latching tool (206) is connected to the downhole end of the completion string (122) as the completion string (122) is made-up and installed in the well (100). In FIG. 4*a*, the coiled tubing BHA (204) and the coiled tubing (202) has not been run into the well (100) or been engaged with the latching tool (206).

FIG. 4*a* also shows a cover (260) in accordance with one or more embodiments, the cover (260) is used to prevent debris from filling the inside of the completion string (122). The cover (260) is located within the completion string (122) and may be located up hole from the latching tool (206). The cover (260) may be a breakable disk (made of a material such as glass or ceramic) or a grease plug without departing from the scope of the disclosure herein.

FIG. 4*b* shows the coiled tubing (202) and the BHA (204) run into the completion string (122) and engaged with the latching tool (206). In accordance with one or more embodiments, the coiled tubing (202) lowers the BHA (204) on top of the latching tool (206). As the latching tool (206) enters the BHA (204), the latch mechanism (234) is triggered enabling a connection between the latching tool (206) and the BHA (204). The latching tool (206) is shown in the first position in FIG. 4*b*, and weight and rotational ability is not transferred from the coiled tubing (202) to the milling section (208). In accordance with one or more embodiments, the coiled tubing (202) may break the cover (260) as the coiled tubing (202) enters the inside of the completion string (122).

Figure 4D:
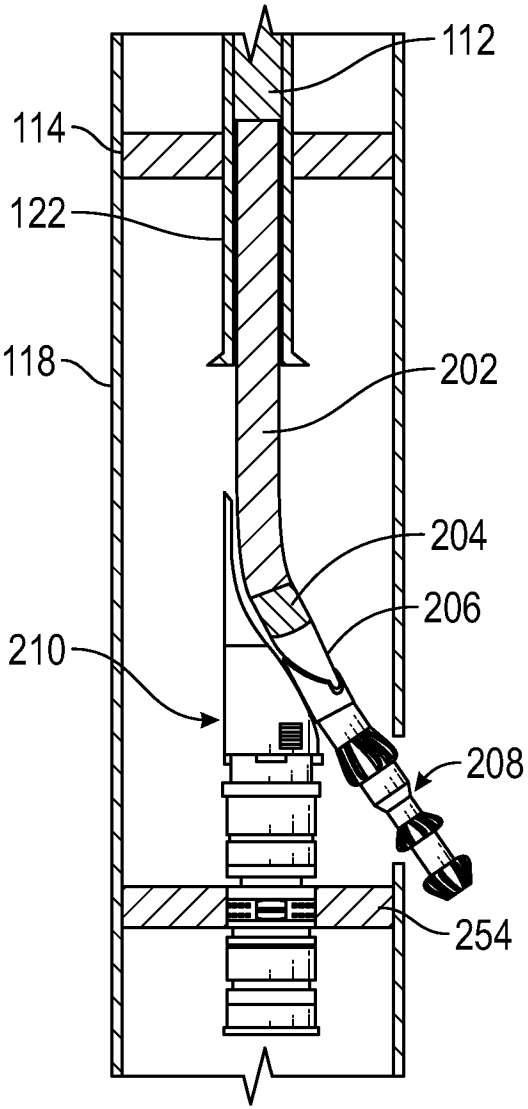
Figure 4C:
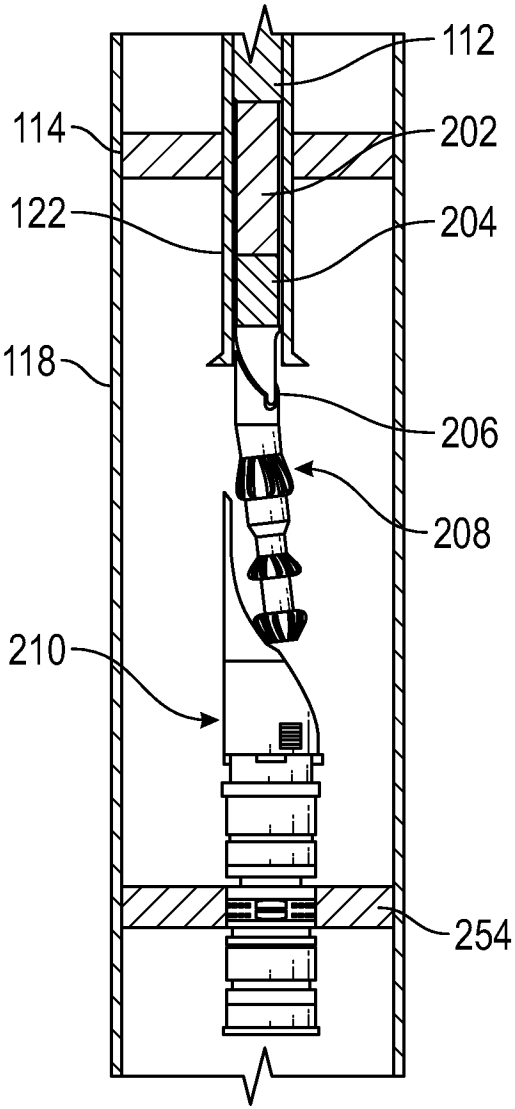

FIG. 4*c* shows the sidetrack system (200) when the latching tool (206) is in the second position and after the anchor shear pins (256), the completion shear pins (258), and the mill shear pins (248) have been broken. In accordance with one or more embodiments and after the latching tool (206) is placed in the second position, weight and rotational force is able to be transferred to the milling section (208). As such, the anchor shear pins (256) may be broken by applying a first slack off weight or by applying a first hydraulic pressure, depending on the type of whipstock (210).

In accordance with one or more embodiments, slack-off weight is the weight of the coiled tubing (202) and BHA (204) being released by the coiled tubing unit. The amount of slack-off weight may be controlled by how much of the coiled tubing (202) and BHA (204) weight is released by the coiled tubing unit. As can be seen in FIG. 4*c*, the anchor slips (254) have jutted out from the whipstock (210) and are engaged with the inner circumferential surface of the production casing (118) due to the anchor shear pins (256) having been broken.

The completion shear pins (258) may be broken by applying a second slack off weight or by applying a second hydraulic pressure, depending on the type of whipstock (210). Once the completion shear pins (258) are broken, the sidetrack system (200) is disconnected from the completion string (122). The mill shear pins (248) may be broken by applying a third slack off weight or by applying a third hydraulic pressure, depending on the type of whipstock (210). As can be seen in FIG. 4*c*, the milling section (208) is free to use the whipstock (210) to begin the sidetrack/milling operation. FIG. 4*d*, shows a progression of the milling section (208) after having milled through the production casing (118).

In accordance with one or more embodiments, the milling/sidetrack operation may begin after the coiled tubing BHA (204) is engaged with the latch mechanism (234) and after the shear pins have all been broken. The milling operation may begin by pumping a fluid through the coiled tubing (202) and BHA (204) to activate the mud motor (222). Further, slack off weight may be applied to the system to enable the milling section (208) to kick off of the ramp (250) into the side wall of the production casing (118).

The weight from the coiled tubing (202) and the rotational movement of the bits from the milling section (208) may cause a hole to be drilled/milled into the side wall of the production casing (118). From this hole the milling section (208) and coiled tubing (202) may be able to access other portions of the well (100). In further embodiments, the milling section (208) may continue to drill through any and all subsequent casing strings and/or formations that the production casing (118) may be located within.

While FIGS. 4*a*-4*d* show the sidetrack system (200) being used to drill through production casing (118), the sidetrack system (200) may be used to drill through an open hole (120) if the whipstock (210)-portion of the sidetrack system (200) extends into the open hole (120). In such as scenario, the anchor slips (254) engage with the open hole (120), rather than with the production casing (118), and the milling section (208) drills directly through the open hole (120), rather than through the production casing (118).

Figure 5:
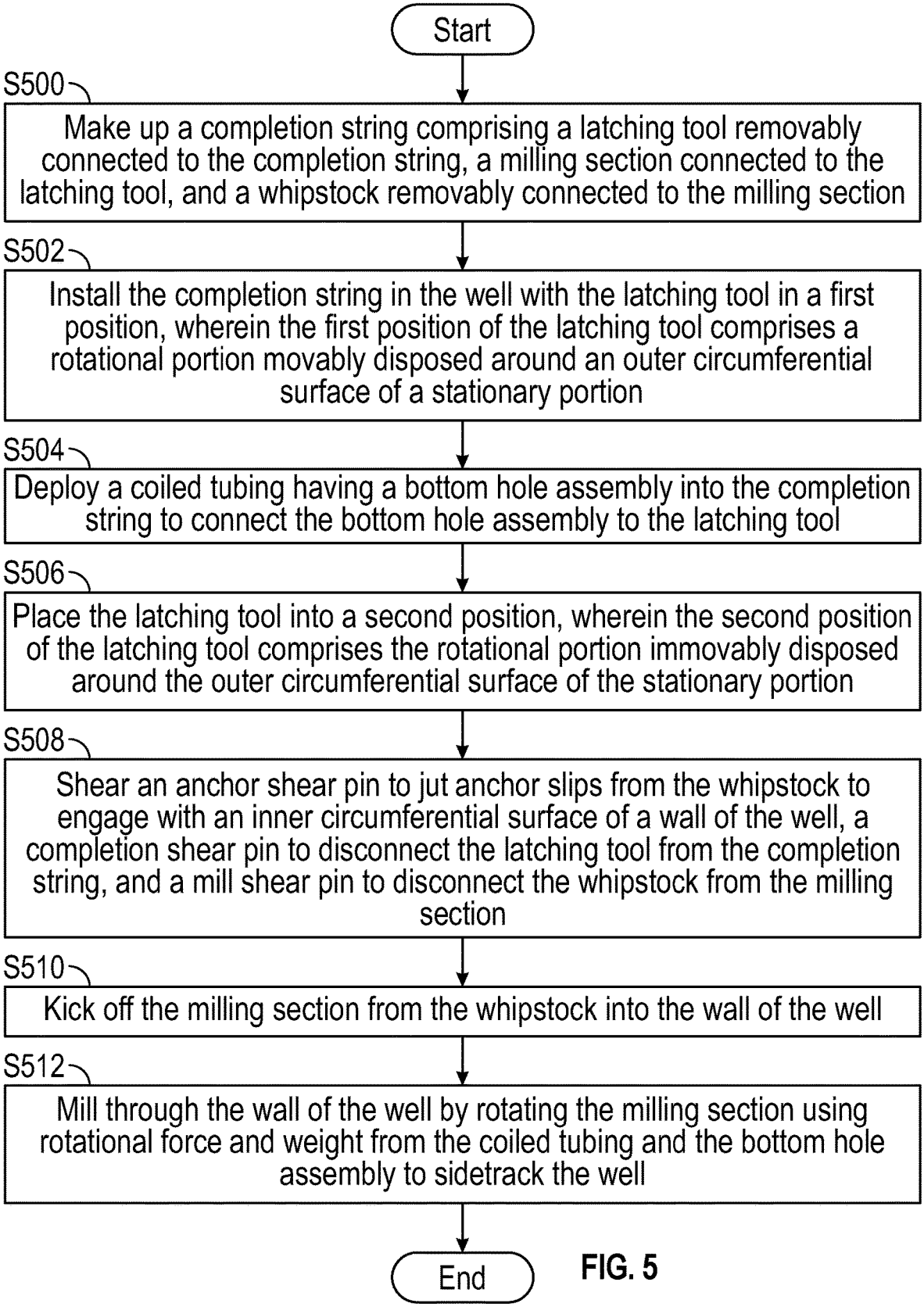
FIG. 5 shows a flowchart in accordance with one or more embodiments.

FIG. 5 shows a flowchart in accordance with one or more embodiments. The flowchart outlines a method for sidetracking a well (100). While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S500, a completion string (122) is made up. The completion string (122) comprises a latching tool (206) removably connected to the completion string (122), a milling section (208) connected to the latching tool (206), and a whipstock (210) removably connected to the milling section is made up.

In S502, the completion string (122) is installed in the well (100) with the latching tool (206) in a first position, wherein the first position of the latching tool (206) comprises a rotational portion (224) movably disposed around an outer circumferential surface of a stationary portion (226). In accordance with one or more embodiments, the completion string (122) is installed in production casing (118). In accordance with one or more embodiments, the latching tool (206) being in the first position prevents weight or rotation to be transferred to the milling section (208), and, thus, the remainder of the sidetrack system (200), from the BHA (204). After the completion string (122) is installed in the well (100), the drilling rig may be released, and a coiled tubing unit may be brought to the location.

In S504, a coiled tubing (202) having a bottom hole assembly (204) is deployed into the completion string (122) to connect the bottom hole assembly (204) to the latching tool (206). In accordance with one or more embodiments, the coiled tubing (202) is connected to the BHA (204) through a connector (212) in the BHA (204). The connector (212) may enable physical connection and electronic communication between the coiled tubing (202) and the BHA (204). The connector (212) may enable connection of any type known in the art such as a welded connection, latched connection, bolted connection, threaded connection etc.

The BHA (204) may include a check valve (214) that prevents fluids from migrating up the coiled tubing (202) to the surface location (110), a disconnect (218) that allows the BHA (204) to disconnect from the milling section (208), and a set of jars (216) that create tensile or compressive forces to move through the BHA (204) and the coiled tubing (202), if the coiled tubing (202) or BHA (204) becomes stuck. The BHA (204) may also include a vibrational tool (220) that causes vibrational forces to extend from the BHA (204) through the coiled tubing (202) and a mud motor (222) that uses a force of fluid to create rotational movement of components located downhole of the mud motor (222).

In accordance with one or more embodiments, the latching tool (206) may be connected to the BHA (204) using a latch mechanism (234). The latch mechanism (234) uses a spring (238) loaded lever (236) to engage with a notch (240) machined into the latching tool (206). In accordance with one or more embodiments, the spring (238) loaded lever (236) is located inside of the BHA (204) and is inserted into the notch (240) in the latching tool (206) when the latching tool (206) is inserted into the BHA (204).

The spring (238) loaded lever (236) may activate due to mechanical means. For example, the latching tool (206) may push the lever (236) radially outward and into the body of the BHA (204) until the lever (236) is aligned with the notch (240). At this point, the lever (236) springs into the space created by the notch (240). In other embodiments, the spring (238) loaded lever (236) may activate due to electronic means. For example, an electronic signal may be sent to the BHA (204) along the coiled tubing (202). The signal may instruct the BHA (204) to insert the lever (236) into the notch (240) via a release of the spring (238).

In S506, the latching tool (206) is placed into a second position. The second position of the latching tool (206) comprises the rotational portion (224) immovably disposed around the outer circumferential surface of the stationary portion (226). In accordance with one or more embodiments, the latching tool (206) is placed in the second position by rotating the rotational portion (224) about the stationary portion (226). The rotational portion (224) may be rotated about the stationary portion (226) by applying weight to the rotational portion (224) or by activating the mud motor (222) in the BHA (204).

Rotation of the rotational portion (224) about the stationary portion (226) enables a key (232) of the rotational portion to be guided into a slot (230) of the stationary portion (226) using a guide groove (228) of the stationary portion (226). By placing the key (232) into the slot (230), the latching tool (206) is placed in the second position. When the latching tool (206) is in the second position, weight and rotation may be transferred to the milling section (208), and, thus, the remainder of the sidetrack system (200), from the BHA (204).

In S508, an anchor shear pin (256) is sheared to jut anchor slips (254) from the whipstock (210) to engage with an inner circumferential surface of a wall of the well (100), a completion shear pin (258) is sheared to disconnect the latching tool (206) from the completion string (122), and a mill shear pin (248) is sheared to disconnect the whipstock (210) from the milling section (208). In accordance with one or more embodiments, the wall of the well (100) may be an inner circumferential surface of a casing string, such as the production casing (118), or the open hole (120). In accordance with one or more embodiments, the anchor shear pin (256) may be sheared by applying a first pressure to the whipstock (210). The first pressure may include slack off weight or hydraulic pressure being pumped on the whipstock (210) through the coiled tubing (202).

In accordance with one or more embodiments, the completion shear pin (258) may be sheared by applying a second pressure to the whipstock (210). The second pressure may include slack off weight or hydraulic pressure being pumped on the whipstock (210) through the coiled tubing (202). The mill shear pin (248) may be sheared by applying a third pressure to the whipstock (210). The third pressure may include slack off weight or hydraulic pressure being pumped on the whipstock (210) through the coiled tubing (202). In accordance with one or more embodiments, the third pressure is larger than the second pressure and the second pressure is larger than the first pressure. This is so that the whipstock (210) may be set within the production casing (118) prior to the milling section (208) being disconnected from the whipstock (210) and prior to the latching tool (206) being disconnected from the completion string (122).

In S510, the milling section (208) is kicked off from the whipstock (210) into a wall of the well (100). The milling section (208) may be directed along the ramp (250) of the whipstock (210). The ramp (250) may direct the lead mill (242) of the milling section (208) into the wall of the well (100). The whipstock (210) may be set within the well (100) in a particular position such that the ramp (250) is directed towards a particular direction.

In S512, the wall of the well (100) is milled through by rotating the milling section (208) using rotational force and weight from the coiled tubing (202) and the BHA (204). Specifically, the mills (i.e., the lead mill (242), the follow mill (244), and the melon mill (246) of the milling section (208) may break down the metal or rock in the well (100) to create a hole.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system for sidetracking a well having a completion string, the system comprising:

coiled tubing connected to a bottom hole assembly;

a latching tool removably connected to the completion string using a completion shear pin, configured to connect to the bottom hole assembly, having a stationary portion and a rotational portion overlayed on top of the stationary portion, wherein a first position of the latching tool comprises the rotational portion movably disposed around an outer circumferential surface of the stationary portion and a second position of the latching tool comprises the rotational portion immovably disposed around the outer circumferential surface of the stationary portion;

a milling section connected to the latching tool and configured to receive weight and rotational movement from the coiled tubing to sidetrack the well when the latching tool is in the second position; and a whipstock removably connected to the milling section via a mill shear pin and having anchor slips configured to jut out into and engage with an inner circumferential surface of the well when an anchor shear pin is broken.

2. The system of claim 1, wherein the stationary portion of the latching tool comprises a guide groove and a slot.

3. The system of claim 2, wherein the rotational portion of the latching tool comprises a key.

4. The system of claim 3, wherein the first position comprises the key located outside of the slot and the second position comprises the key engaged with the slot.

5. The system of claim 4, wherein the key is configured to use the guide groove to enter and engage with the slot.

6. The system of claim 3, wherein the latching tool is configured to move from the first position to the second position by rotating the rotational portion about the stationary portion.

7. The system of claim 3, wherein the latching tool is configured to connect to the bottom hole assembly using a latch mechanism.

8. The system of claim 7, wherein the latch mechanism comprises a spring loaded lever located in the bottom hole assembly.

9. The system of claim 8, wherein the latch mechanism comprises a notch machined into the latching tool and configured to receive the spring loaded lever.

10. The system of claim 1, wherein the anchor shear pin is configured to shear using a first pressure applied to the whipstock from the coiled tubing, the completion shear pin is configured to shear using a second pressure applied to the whipstock from the coiled tubing, and the mill shear pin is configured to shear using a third pressure from the coiled tubing, wherein the third pressure is greater than the second pressure and the second pressure is greater than the first pressure.

11. A method for sidetracking a well, the method comprising:

making up a completion string comprising a latching tool removably connected to the completion string, a milling section connected to the latching tool, and a whipstock removably connected to the milling section;

installing the completion string in the well with the latching tool in a first position, wherein the first position of the latching tool comprises a rotational portion movably disposed around an outer circumferential surface of a stationary portion;

deploying a coiled tubing having a bottom hole assembly into the completion string to connect the bottom hole assembly to the latching tool;

placing the latching tool into a second position, wherein the second position of the latching tool comprises the rotational portion immovably disposed around the outer circumferential surface of the stationary portion;

shearing an anchor shear pin to jut anchor slips from the whipstock to engage with an inner circumferential surface of a wall of the well, a completion shear pin to disconnect the latching tool from the completion string, and a mill shear pin to disconnect the whipstock from the milling section;

kicking off the milling section from the whipstock into the wall of the well; and milling through the wall of the well by rotating the milling section using rotational force and weight from the coiled tubing and the bottom hole assembly to sidetrack the well.

12. The method of claim 11, wherein connecting the bottom hole assembly to the latching tool further comprises connecting the latching tool to the bottom hole assembly using a latch mechanism.

13. The method of claim 12, wherein connecting the latching tool to the bottom hole assembly using the latch mechanism further comprises inserting a spring loaded lever from the bottom hole assembly into a notch in the latching tool.

14. The method of claim 11, wherein placing the latching tool into the second position further comprises activating a mud motor in the bottom hole assembly to rotate the rotational portion about the stationary portion.

15. The method of claim 14, wherein activating the mud motor further comprises pumping a fluid through the coiled tubing into the bottom hole assembly.

16. The method of claim 14, wherein rotating the rotational portion about the stationary portion further comprises guiding a key of the rotational portion into a slot of the stationary portion using a guide groove of the stationary portion.

17. The method of claim 16, wherein placing the latching tool into the second position further comprises inserting the key into the slot.

18. The method of claim 11, wherein shearing the anchor shear pin further comprises applying a first pressure to the whipstock.

19. The method of claim 18, wherein shearing the completion shear pin further comprises applying a second pressure to the whipstock.

20. The method of claim 19, wherein shearing the mill shear pin further comprises applying a third pressure to the whipstock wherein the third pressure is greater than the second pressure and the second pressure is greater than the first pressure.

* * * * *